US009915083B2

(12) United States Patent
Ford

(10) Patent No.: US 9,915,083 B2
(45) Date of Patent: Mar. 13, 2018

(54) DOOR SECURING SYSTEM

(71) Applicant: Glenn Ford, Clairton, PA (US)

(72) Inventor: Glenn Ford, Clairton, PA (US)

( * ) Notice: Subject to any disclaimer, the term of this patent is extended or adjusted under 35 U.S.C. 154(b) by 0 days.

(21) Appl. No.: 14/837,107

(22) Filed: Aug. 27, 2015

(65) Prior Publication Data

US 2016/0060940 A1 Mar. 3, 2016

Related U.S. Application Data

(60) Provisional application No. 62/042,965, filed on Aug. 28, 2014.

(51) Int. Cl.

| | |
|---|---|
| ***E05B 63/00*** | (2006.01) |
| ***E05F 15/70*** | (2015.01) |
| ***E05B 47/02*** | (2006.01) |
| ***E05C 17/56*** | (2006.01) |

(52) U.S. Cl.

CPC ..... *E05B 63/0052* (2013.01); *E05B 47/02* (2013.01); *E05B 63/0004* (2013.01); *E05C 17/56* (2013.01); *E05F 15/70* (2015.01)

(58) Field of Classification Search

CPC . Y10T 16/61; Y10T 70/5164; E05B 63/0052; E05B 63/0004; E05B 47/02; E05F 15/614; E05F 15/616; E05F 15/70; E05C 17/56; E05C 17/44

See application file for complete search history.

(56) References Cited

U.S. PATENT DOCUMENTS 1,646,181 A * 10/1927 Babekuhl ..... E05B 83/02 292/199
2,407,900 A * 9/1946 Paul ..... E05C 17/32 292/263
3,129,936 A * 4/1964 Carlson ..... E05F 3/223 49/264
3,435,558 A 4/1969 Kruse
3,854,310 A * 12/1974 Paull ..... E05B 47/0012 292/201
4,125,966 A * 11/1978 Penn ..... E05F 15/649 49/349
4,226,453 A 10/1980 Robertson
4,403,449 A * 9/1983 Richmond ..... E05F 15/63 403/323
4,420,954 A 12/1983 Hieronymi et al.
4,697,383 A 10/1987 Hagiwara
4,928,430 A * 5/1990 George ..... E06B 7/367 49/460
4,929,003 A * 5/1990 McConnell ..... E05B 47/0012 292/144
5,036,620 A * 8/1991 Beran ..... E05D 15/54 49/141
5,360,245 A * 11/1994 David ..... E05C 19/182 292/289
5,465,460 A * 11/1995 Cantone ..... E05C 17/50 16/82
5,469,139 A * 11/1995 Ko ..... E05C 17/166 200/61.93

(Continued)

*Primary Examiner* — Justin B Rephann
(74) *Attorney, Agent, or Firm* — Cozen O'Connor

(57) ABSTRACT

A door closing mechanism utilizing a motor and a worm gear to engage with a gear drive attached to an engagement mechanism that is capable of pressing against a force applied to a door and shutting the door against such force.

11 Claims, 7 Drawing Sheets

(56) References Cited

U.S. PATENT DOCUMENTS 5,605,365 A * 2/1997 George ..... E05C 17/166 292/263
5,865,480 A * 2/1999 Bain, Jr. ..... E05B 65/0014 292/109
5,899,509 A * 5/1999 Ferguson ..... E05C 19/003 292/259 R
6,046,562 A 4/2000 Emil
6,058,563 A * 5/2000 Bucknell ..... E05C 17/50 16/82
6,244,636 B1 * 6/2001 Rissone ..... E05B 63/0069 16/82
6,520,551 B1 2/2003 Crnkovich
6,588,153 B1 * 7/2003 Kowalczyk ..... E05F 15/603 49/280
6,634,140 B1 * 10/2003 Sellman ..... E05F 15/63 49/340
6,891,479 B1 * 5/2005 Eccleston ..... E05F 15/63 116/86
7,143,547 B2 * 12/2006 Liles, Jr. ..... E05F 1/105 49/340
7,571,877 B2 * 8/2009 French ..... B64C 1/1469 16/61
7,591,102 B1 9/2009 Evans
8,225,458 B1 * 7/2012 Hoffberg ..... E05F 3/102 16/49
8,360,537 B2 * 1/2013 Gasser ..... F16H 21/40 312/319.5
8,776,316 B2 * 7/2014 McRoskey ..... E05F 5/02 16/82
2005/0091928 A1 * 5/2005 Okulov ..... E05F 15/74 49/341
2007/0022664 A1 * 2/2007 Mahonen ..... E05F 3/102 49/342
2012/0029701 A1 * 2/2012 Houser ..... E05F 15/40 700/275

* cited by examiner

DOOR SECURING SYSTEM

CROSS-REFERENCE TO RELATED APPLICATIONS

This application claims priority to U.S. provisional application Ser. No. 62/042,965 filed Aug. 28, 2014, which is incorporated herein by reference in its entirety.

FIELD OF INVENTION

The present application is generally related to devices for preventing entry into or through a door by an unwanted person.

BACKGROUND OF THE INVENTION

Currently, home invasions are a problem. A device is needed to help keep intruders from forcing their way through the doorway of people's homes. Currently, there are no good ways to prevent break-ins. Locks can be broken, and door chains are also quite weak. As such, there is a real risk of home invasion, including invasion where an intruder comes to a door while individuals are home. Intruders use various tactics to engage someone inside the home to open the door, and once the door is open, they utilize force to open the door It is possible to use certain door chains or other devices that allow the door to be opened only a few inches, however, these devices do not also assist with shutting the door against a force from an intruder.

A closing system for a door, is thus provided. The present door closing system provides a small profile at a door, but also provides sufficient force to assist with, or entirely close the slightly open or ajar door to prevent a force entry.

SUMMARY OF THE INVENTION

In one embodiment, a door closing mechanism includes a motor, a worm screw operably coupled to the motor and having threads disposed within the pitch circle of a worm gear, a spur gear mounted coaxially to the worm gear, and a movable arm. The movable arm has a distal end and a proximal end, wherein the proximal end has a plurality of gear teeth in contact with the spur gear at a pitch point such that the spur gear reversibly actuates the distal end of the movable arm from an open position to a closed position.

In another embodiment, the door closing mechanism includes a micro controller, a motor driver, a power supply, and a force transducer, wherein the force applied to an open door is measured by the force transducer. Upon sufficient force being applied to the door, the force transducer engages the microcontroller, which, in turn powers the motor driver and the motor to close the door.

In another embodiment, the door closing mechanism includes an extend button and a retract switch.

In yet another embodiment, the door closing mechanism includes a wireless device having an extend button and a retract switch.

In one embodiment, the door closing mechanism is mounted on an adjacent structure.

In another embodiment, the door closing mechanism has a cover.

In one embodiment, the door closing mechanism includes a door press on the distal end of the movable arm.

In another embodiment, the door closing mechanism includes an attachment mechanism securing the door press to a door.

Another embodiment provides a door closing security system for closing a slightly open door against a force applied on the outside of the door to force open said door, and includes a motor, an arm, a force transducer, a microcontroller, a worm, a worm gear, and a spur gear, wherein the door closing security system is mounted on the door frame adjacent to the door, such that the arm can contact the inside of the door, but also be rotated away from the door to allow the door to operate normally. In response to a force being applied to a slightly open door, the force transducer engages the microcontroller to turn on the motor, wherein the motor drives the worm which is engaged with teeth on the worm gear; and wherein a spur gear, mounted on said worm gear is rotated, and wherein said spur gear is engaged with teeth of the arm, which forces the arm to rotate, closing the door against said force.

DETAILED DESCRIPTION OF THE EMBODIMENTS

The embodiments of the invention and the various features and advantages thereto are more fully explained with references to the non-limiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the claims.

As used herein, terms such as "a," "an," and "the" include singular and plural referents unless the context clearly demands otherwise.

As used herein, the term "about" means within 10% of a stated number.

Figure 1:
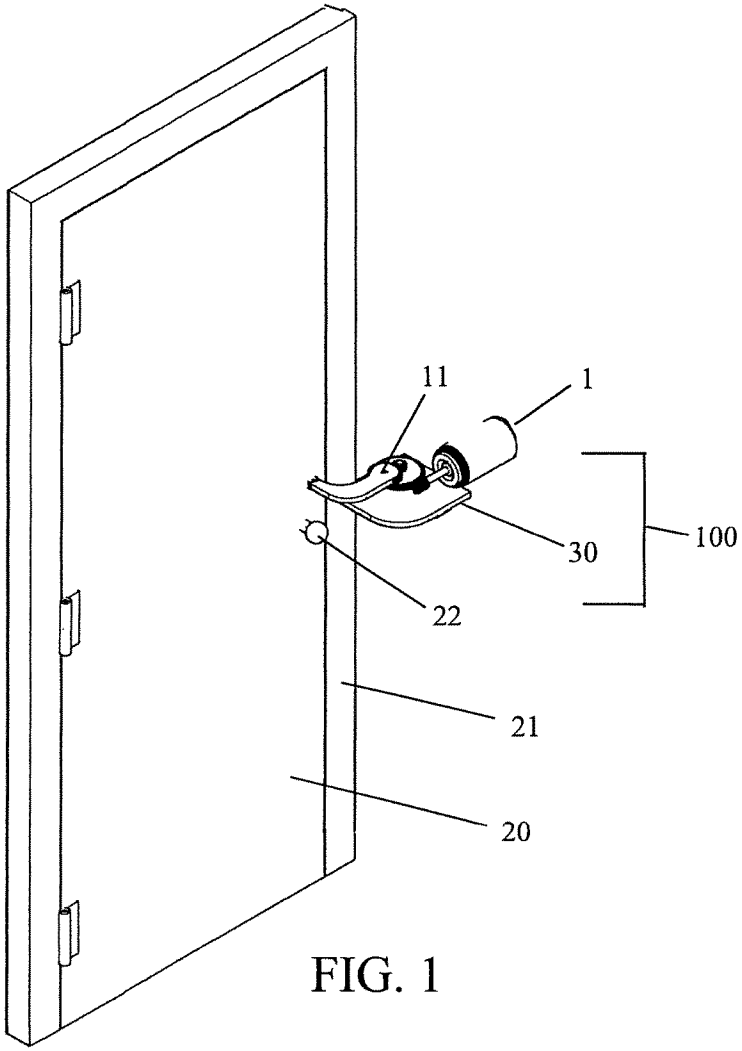
FIG. 1 provides a view of the door closing mechanism attached adjacent to the door, where the door is in a closed position.

FIG. 1 provides an exemplary view of an embodiment of the door closing mechanism, wherein the door closing mechanism 100 is attached to the wall or door frame 21 adjacent to the door 20. The door closing mechanism 100 comprises a motor 1, a securing plate 30, a shutting gear 11.

Figure 2:
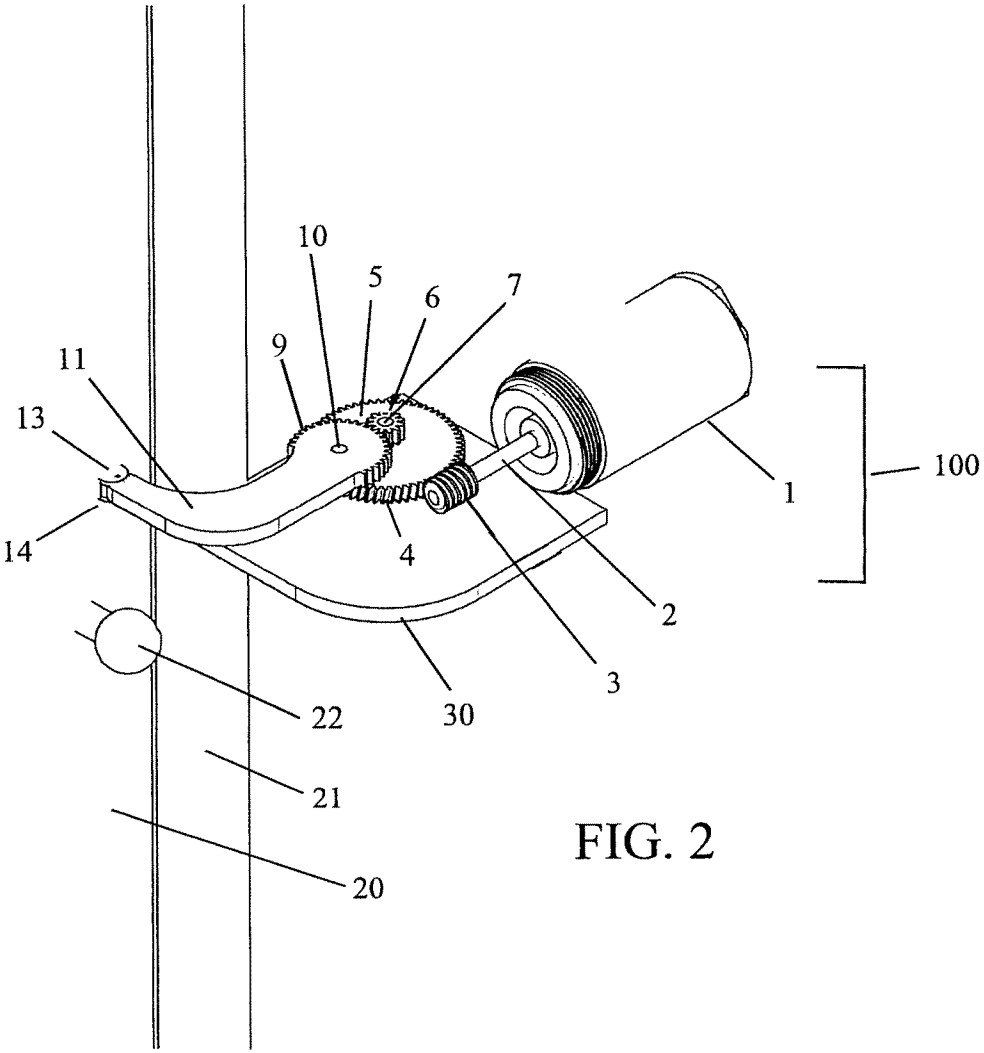
FIG. 2 provides a further view of the door closing mechanism engaged to the door where the door is shut.

The features of the door closing mechanism 100 are shown in greater detail in FIG. 2. As depicted in one embodiment, the motor 1 is connected to the proximal end of a drive shaft 2. A worm screw 3 is disposed on the distal end of the drive shaft such that the threads of the worm screw 3 are disposed within the pitch circle of a worm gear 5. Worm gears, as known to one of ordinary skill in the art utilize a worm screw 3 (also just referred to as a worm), and attaches to a worm gear 5 (also referred to as a worm wheel). A particular benefit of using worm gears is the ability to reduce rotational speed and allow higher torque to be transmitted. The particular ratio and size of the worm 3 to the worm gear 5 can be ascertained by one of ordinary skill in the art, so as to provide for sufficient force necessary in the present application, to open a door, and shut a door against a force.

FIG. 2 further identifies that a spur gear 7 is attached to the worm gear 5. Preferably, spur gear 7 is mounted coaxially to worm gear 5, such that spur gear 7 and worm gear 5 rotate about an axle 6. The spur gear 7 contacts a plurality of teeth 9 disposed at the proximal end of movable arm 11 to create a pitch point such that rotation of the spur gear actuates rotation of the distal end of movable arm 11 from an open position to a closed position. Accordingly, action from the motor drives the worm 3, which engages to the worm gear 5 and simultaneously rotates the spur gear 7, which, being in contact with the plurality of teeth 9, rotates movable arm 11.

In one embodiment, movable arm 11 has about a 90 degree bend such that contact between a door and the distal end of movable arm 11 is approximately perpendicular. A door press 13 is disposed at the distal end of movable arm 11. In one embodiment, press anchor 14 couples door press 13 to the distal end of movable arm 11 and provides door press 13 a degree of freedom to rotate such that door press 13 can remain in stable contact with the door as the door opens and closes. Preferred attachment allows for a degree of rotational movement of about 180 degrees.

Indeed, the purpose of the door closing mechanism 100 is to allow an individual to slightly open the door 20 to see who is at the door, and then be able to shut the door, should a person outside the door be unwelcomed. Accordingly, the door does not need to open more than a few inches to allow this communication to occur.

However, in certain embodiments, the mechanism provides for sufficient movement of the door to allow a pet to enter or exit the house, without disengaging the door closing mechanism 100 from the door 20.

In certain embodiments, the door press 13 is secured to the door via a latch or snap or other selective attachment mechanism, so that should a user need to engage the door closing mechanism 100, the door press 13 would be secured to the door and prevent unauthorized movement of the door by another.

Figure 3:
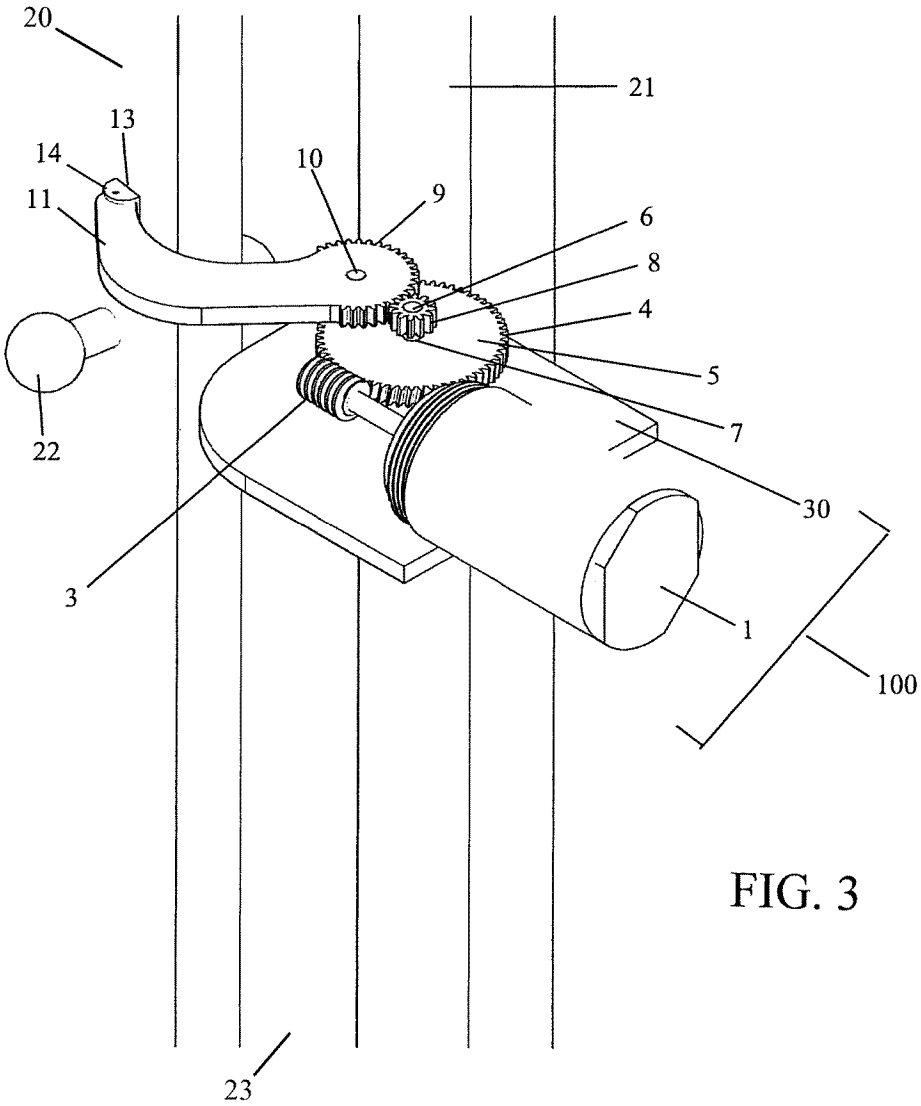
FIG. 3 provides a view of the door closing mechanism engaged to the door where the door is partially open.

FIG. 3 further depicts the door closing mechanism 100 wherein the door is slightly open. This is an intended position, to allow a user to open the door 20, to create a small door opening 23 between the door 20 and the door frame 21. Furthermore, FIG. 3 provides a rotated view of the door closing mechanism 100 from FIG. 2. It is particularly noted that the mount 30 provides a base for securing the various gears, motor, as well as electronic components suitable for working the door closing mechanism 100. In particular, the spur gear 7 and the worm gear 5 are aligned on an axle 6, which is connected to the mount 30. Furthermore, an arm axle 10 is positioned to allow the arm 11 to rotate, and the arm axle 10 is also secured to the mount 30.

Figure 4:
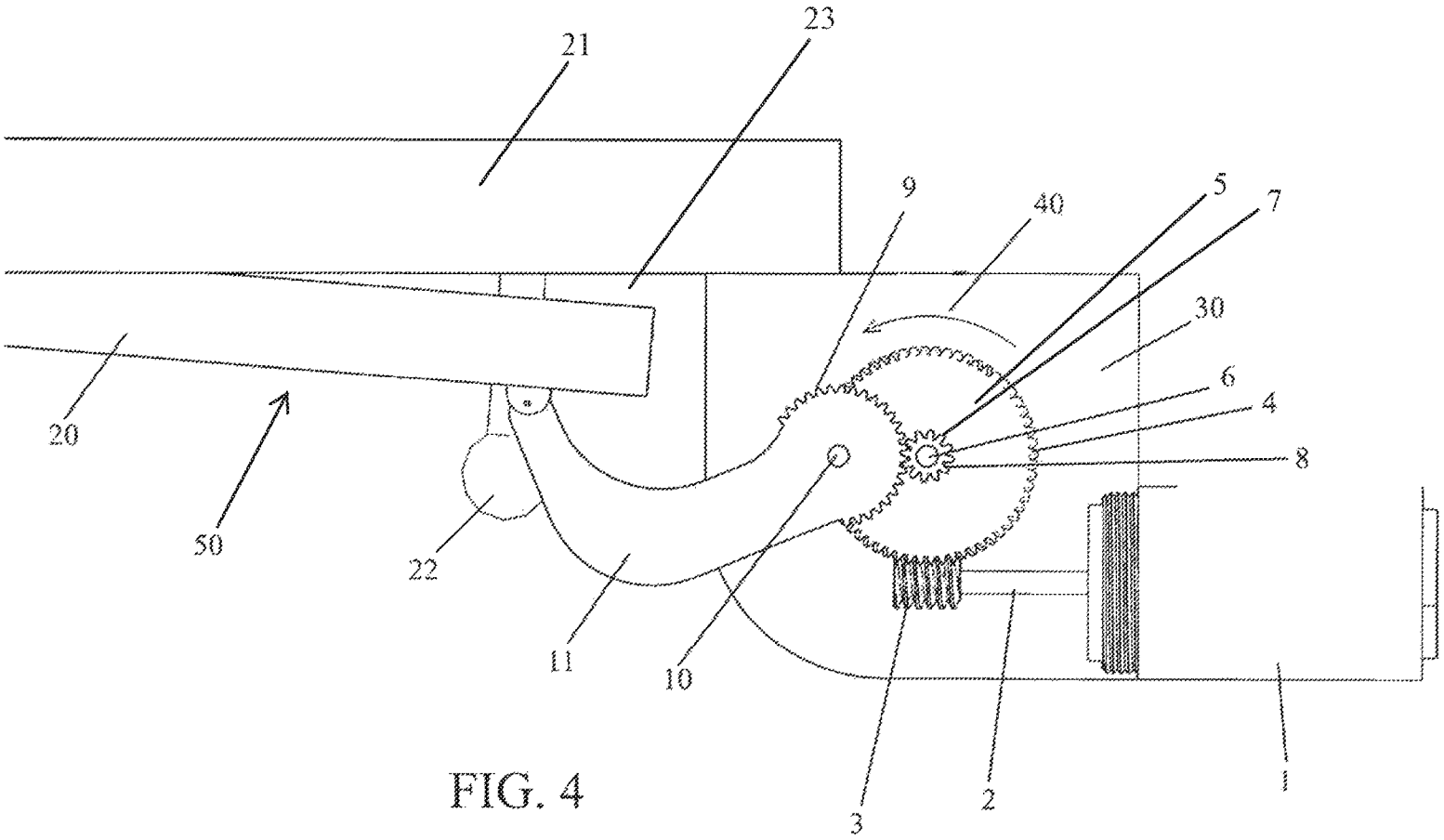
FIG. 4 provides a further view of the door mechanism engaged to the door where the door is partially opened.

FIG. 4 provides a top down view of the door closing mechanism, and again depicts the door 20 slightly ajar, creating an opening 23 between the door 20 and the door frame 21. It is particular defined that the door, being closed (moving in the direction of the arrow 50) rotates the worm gear 5 in a counter-clockwise manner (depicted by arrow 40). This also rotates the spur gear 7 in a counter-clockwise direction. The spur gear 7 having spur teeth 8 engaged with the teeth on the arm gear 9, rotates the arm gear 9 (and the arm) in a clockwise manner, thus forcing the door closed.

Figure 5:
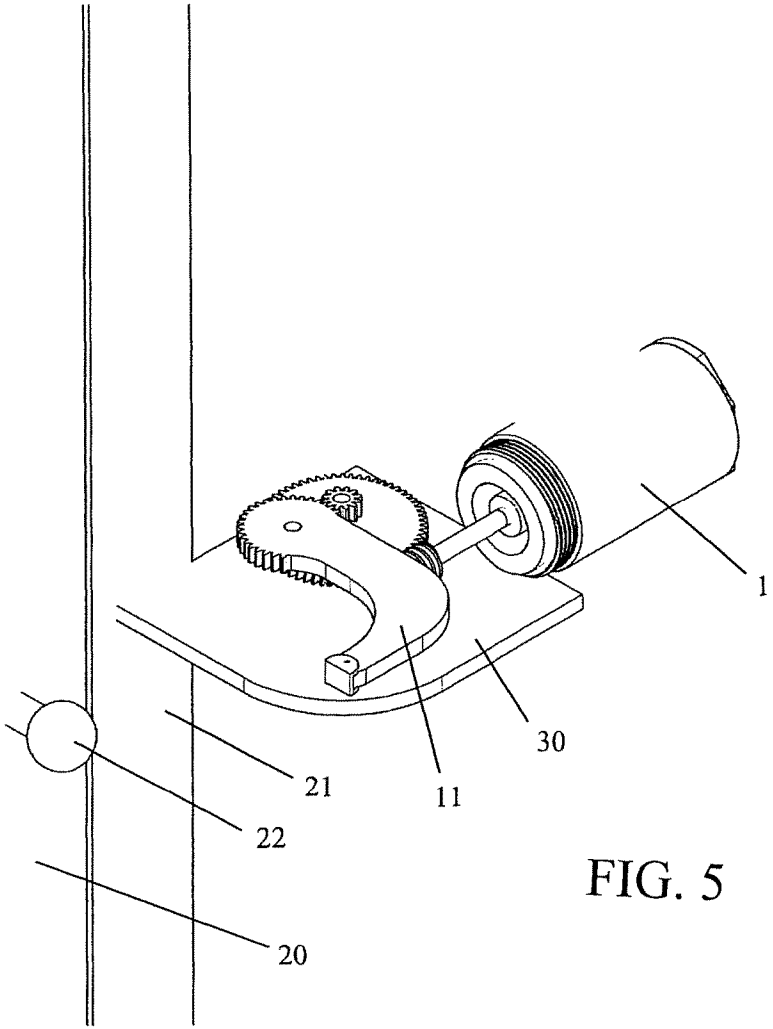
FIG. 5 provides a perspective view of the door mechanism in a retracted position.

FIG. 5 depicts the door closing mechanism wherein the arm 11 is withdrawn from the door 20. Once the arm 11 is withdrawn from the door 20, the door 20 functions in a completely normal manner, wherein someone would ordinarily use the door knob 22 to open or close the door, or to open or close the latch mechanism that normally secures the door.

Figure 6:
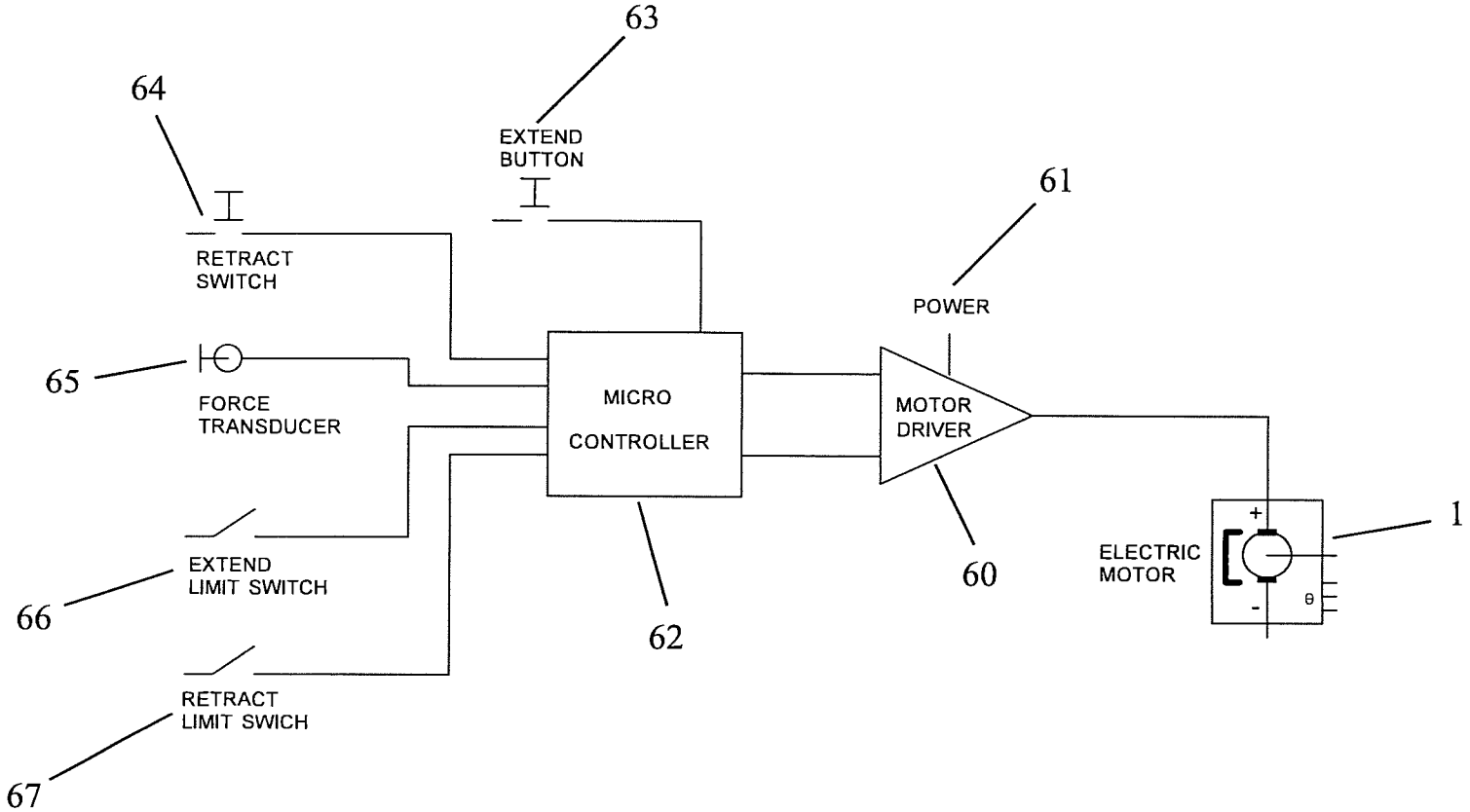
FIG. 6 provides an overview of a schematic of a flow chart for the electronics of a door closing mechanism.
Figure 7:
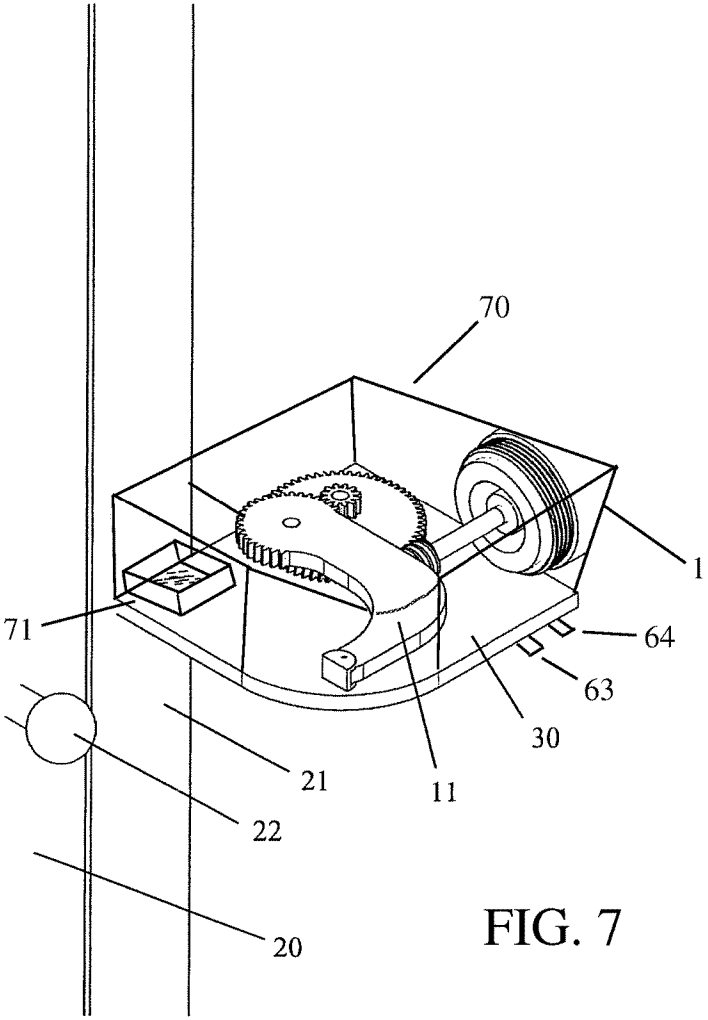
FIG. 7 provides a perspective view of the door mechanism and electronics box encased in a cover.

The mount 30 is depicted as only a bottom fixture, however, in preferred embodiments, and as known to one of ordinary skill in the art, the mount can further include a cover 70 that attaches over the gears as shown in FIG. 7. Appropriate openings to allow for the movement of the arm are necessary. The mount 30 may also include several switches that allow the user to operate the door closing mount. FIG. 6 provides a flow-chart of certain electrical components and their orientation to work the door closing mechanism.

In another embodiment, the door closing mechanism further comprises the following components: a micro controller 62, a motor driver 60, a power supply 61, an electric motor 1, an extend button 63, a retract switch 64, a force transducer 65, an extend limit switch 66, a retract limit switch 67. These components can be attached to the mount 30, or attached to the door frame 22, or other place that is suitable for housing such electronics as shown in FIG. 7. Furthermore, the appropriate switches may be further secured to the mount 30 with appropriate openings to engage the switches when appropriate, or the switches can be secured to the wall or other location that is suitable for use.

The embodiment as shown in FIG. 7, further illustrates an exemplary cover 70 to encase the door closing mechanism, including the electronics box 71 housing the components shown in FIG. 6. Extend button 63 and retract switch 64 are disposed for easy access. FIG. 7 is merely illustrative of one embodiment of the door closing mechanism and is in no way limiting. Electronics box 71 may be positioned anywhere within the cover or outside the cover. Extend button 63 and retract switch 64 may also be positioned along cover 70 and mount 30. Furthermore, the components shown in FIG. 6 may not be housed in electronics box 71 and may be in various configurations with in cover 70 as dictated by design needs.

When the door closing mechanism is placed on the door frame 23 in its operating positioned, the closing mechanism will be retracted so that the retract limit switch 67 is engaged. If a force of sufficient magnitude is detected by the force transducer 65, the microcontroller will activate the motor driver 60 and will power the motor 1 to close the door until the extend limit switch is engaged.

Similarly, if the extend button is pressed, the micro controller will activate the motor driver 60 which will activate the motor 1 and will close the door until the extend limit switch is engaged.

Activating the retract switch will activate the microcontroller which will activate the motor driver 60 and power the motor 1 which will then retract the door open until the retract limit switch 67.

Therefore, in a situation where an intruder knocks on the exterior of the door, someone inside can open the door slightly to see the person who is on the exterior of the door.

In the case that the person on the exterior is an unwanted person, the door can be shut. This is particularly important, when, after the door is opened, the exterior person presses against the door to attempt to force it open. Where a force is applied against the slightly open door, and the door closing mechanism is engaged, the force transducer 65 will sense the force and the microcontroller 62 will then activate the motor driver 60 and will then power the motor 1 to close the door, against the force from outside.

In certain embodiments, it is considered that the door closing mechanism can be utilized as a remote door answering mechanism that can both open and shut a door. Accordingly, through the use of sensors or switches, the arm 11 could be attached to the door 20, and upon notice from a sensor or switch, the door could be opened slightly ajar to allow someone inside the door to communicate with someone on the outside of the door. For instance, where a delivery is to be made to a location, upon ringing or knocking at the door, the door could be manually or automatically opened slightly, to allow for passage of a document or package. After the delivery, the door could be force closed wherein conventional locking mechanisms can be used to secure the door.

In certain embodiments, wherein a force is applied to the door, the force transducer 65 sends a signal to the micro controller 62 to sound an alarm. The alarm can be a simple audible alarm that provides for recognition of the system being activated. In other embodiments, the alarm can be tied to a remotely monitored alarm system, which notifies police or other services that a forced entry attempt has occurred at the premises.

In yet another embodiment, the micro controller 62 is controlled remotely by an infrared, bluetooth, network, or other wireless device readily known to a person of skill in the art. The wireless device includes a retract switch and extend button providing the added security of opening and closing the door at a distance.

What is claimed is:

1. A door closing mechanism comprising:

a door, having a hinged door jamb and a latching door jamb and having an attached anchor positioned on an inside surface of the door adjacent to the latching door jamp;

a motor disposed adjacent to the latching door jamb and vertically above the location of a doorknob;

a drive shaft comprising a proximal end attached to the motor and a distal end;

a worm screw disposed on the distal end of the drive shaft comprising threads disposed within the pitch circle of a worm gear;

a spur gear mounted coaxially to the worm gear; and a single piece, movable arm, having a 90 degree bend, comprising a distal end and a proximal end, said distal end of said movable arm releasably connected to said anchor on said door, wherein the proximal end of said movable arm comprises a plurality of gear teeth in contact with the spur gear at a pitch point such that the spur gear reversibly actuates the distal end of the movable arm from an open position to a closed position.

2. The door closing mechanism of claim 1 further comprising a micro controller, a motor driver, a power supply, and a force transducer wherein a force applied to the door is measured by the force transducer, wherein upon sufficient force being applied to the door, the force transducer engages the microcontroller, which, in turn powers the motor driver and the motor to close the door.

3. The door closing mechanism of claim 2, further comprising an extend button and a retract switch.

4. The door closing mechanism of claim 3, further comprising a wireless device comprising said extend button and said retract switch.

5. The door closing mechanism of claim 1, further comprising a cover.

6. The door closing mechanism of claim 1, further comprising a door press on the distal end of the movable arm.

7. The door closing mechanism of claim 6, further comprising a press anchor coupling the door press to the distal end of the movable arm, wherein the press anchor provides a degree of rotational movement to the door press about the distal end of the movable arm.

8. The door closing mechanism of claim 7, further comprising an attachment mechanism securing the door press to a door.

9. A method of shutting a door against an external force, the method comprising: applying the external force against the door; providing a door closing mechanism comprising: the door, having a hinged door jamb and a latching door jamb and having an attached anchor positioned on an inside surface of the door adjacent to the latching door jamb; a motor disposed adjacent to the latching door jamb and vertically above the location of a doorknob; a drive shaft comprising a proximal end attached to the motor and a distal end; a worm screw disposed on the distal end of the drive shaft comprising threads disposed within the pitch circle of a worm gear; a spur gear mounted coaxially to the worm gear; and a single piece, movable arm, having a 90 degree bend, comprising a distal end and a proximal end, said distal end of said movable arm releasably connected to said anchor on said door, wherein the proximal end of said movable arm comprises a plurality of gear teeth in contact with the spur gear at a pitch point such that the spur gear reversibly actuates the distal end of the movable arm from an open position to a closed position; and providing a counter force to the door greater than the applied external force.

10. A door closing security system for closing an open door against a force applied on an outside surface of the door to force the door in an open direction, said door comprising an inside surface and said outside surface, the door closing security system comprising a motor, a drive shaft comprising a proximal end attached to the motor and a distal end, a worm screw disposed on to the distal end of the drive shaft comprising threads disposed within the pitch circle of a worm gear, a spur gear mounted coaxially to the worm gear, a single piece movable arm comprising a distal end, comprising a door press for contacting the inside surface of said door, and a proximal end, wherein the proximal end comprises a plurality of gear teeth in contact with the spur gear at a pitch point such that the spur gear reversibly actuates the distal end of the movable arm from an open position to a closed position, a force transducer, and a microcontroller;

wherein the door closing security system is mounted on a door frame adjacent to the door such that the distal end of the movable arm can reversibly rotate toward and away from the inside surface of said door; and wherein response to the force applied to the open door triggers the force transducer to engage the microcontroller to turn on the motor, wherein the motor drives the worm screw which is disposed within the pitch circle of the worm gear; and wherein the spur gear, mounted on said worm gear is rotated, and wherein said spur gear actuates the plurality of teeth at the proximal end of the movable arm at the pitch point, which forces the arm to rotate towards the door, closing the door against said force.

11. The door closing security system of claim 10, wherein said door closing security system is mounted on a latching door jamb of said door frame.

* * * * *